US005098329A

United States Patent [19]

Tseng

[11] Patent Number: 5,098,329

[45] Date of Patent: Mar. 24, 1992

[54] DUAL BALLOON

[76] Inventor: Ming F. Tseng, No. 13, Lane 16, Ta Yuan Rd., Tao Yuan City, Taiwan

[21] Appl. No.: 604,057

[22] Filed: Oct. 26, 1990

[51] Int. Cl.[5] ..... A63H 3/06; A63B 41/00

[52] U.S. Cl. ..... 446/221; 446/224; 273/58 BA; 273/58 F

[58] Field of Search ..... 446/220, 221, 223, 224; 273/58 F, 58 B, 58 BA; 137/223, 855

[56] References Cited

U.S. PATENT DOCUMENTS

| | | | |
|---|---|---|---|
| 1,300,640 | 4/1919 | Pasternak | 446/220 |
| 1,356,817 | 10/1920 | Gregory | 273/58 B |
| 3,693,266 | 9/1972 | Pressman | 446/221 X |
| 4,142,322 | 3/1979 | Zeyra | 446/224 |
| 4,842,563 | 6/1989 | Russell | 446/221 |
| 4,917,381 | 4/1990 | Spector | 273/58 BA |

FOREIGN PATENT DOCUMENTS

| | | | |
|---|---|---|---|
| 162174 | 8/1933 | Switzerland | 446/221 |

*Primary Examiner*—Danton D. DeMille

*Attorney, Agent, or Firm*—Morton J. Rosenberg; David I. Klein

[57] ABSTRACT

A dual balloon comprising an outer sphere and an inner sphere with corresponding conduits placed in the surfaces of the spheres and a connecting trachea being releasable engageable between the conduits and providing an air path from the outside of the outer sphere to the inside of the inner sphere. The inner sphere being able to be free-floating in the outer sphere while remaining inflated and being releasably engageable directly with the outer sphere.

4 Claims, 5 Drawing Sheets

DUAL BALLOON

BACKGROUND OF THE INVENTION

This invention relates to an inflatable balloon, and more particularly, to a dual balloon having two spheres, one inside the other.

A known conventional balloon consisting of a single sphere is a beach ball. It is inflated to a predetermined size and then a plug is inserted into a nipple to maintain the air pressure inside. It can then be played with accordingly, and then subsequently deflated for storage or future use. This type of balloon has been known for a substantial amount of time without any advances or changes other than in the actual size of the beach ball. Although it can be considered a "classic" toy in the sense of its duration, it has become passé with waning popularity.

Therefore, it is the purpose of the present invention to present an apparatus which enables two balloons to be inflated with one of them simultaneously inside the other. And to apply the present invention to the conventional beach ball would increase its interest and popularity, thereby creating or expanding the market for this type of toy.

SUMMARY OF THE INVENTION

Accordingly, it is an object of the present invention to provide a trachea to be releasably engageable between two conduit means of an outer sphere and an inner sphere, thereby allowing the inner sphere to be inflated.

A further object of this invention is to provide male and female attachment means to facilitate the engagement of the trachea with the two conduit means.

Another object of this invention is to provide an annular ring and an annular slot on the respective male and female attachment means to securely engage the trachea with the two conduit means.

Yet a further object of this invention is to provide a valve means to allow the inner sphere to remain inflated while disconnected from the outer sphere.

Yet another object of this invention is to provide conduit means to allow the outer sphere and the inner sphere to be connected directly without the aid of the connecting trachea.

Still a further object of this invention is to provide a supplementary conduit means in the outer sphere to facilitate an inflation process.

Accordingly, after reading the following detailed description and with appropriate reference to the accompanying drawings, these objects, as well as addition objects, will become readily apparent to those skilled in the art; therefore, the above-mentioned objects shall not limit the scope of the present invention.

DETAILED DESCRIPTION OF THE PREFERRED EMBODIMENT

Figure 1:
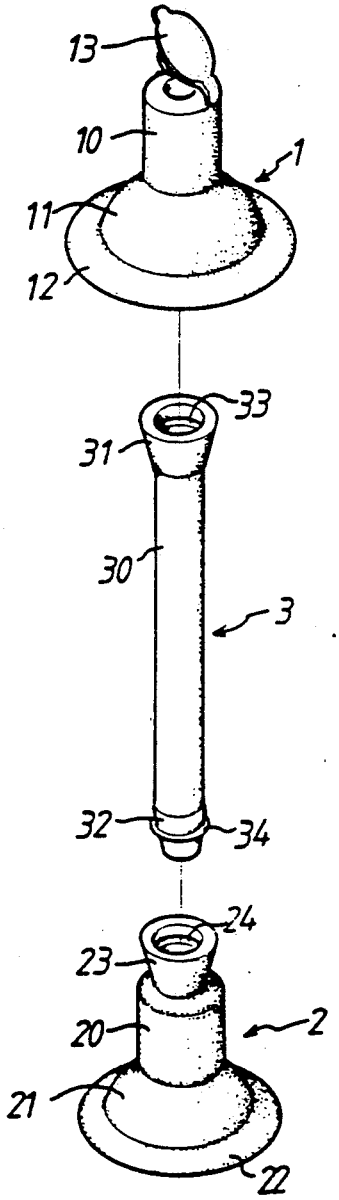
FIG. 1 is an exploded perspective view showing a first and second conduit means and a connecting trachea in accordance with the present invention.

Referencing FIG. 1, there is shown an engaging and inflating structure of a dual balloon in accordance with this invention which generally comprises a first conduit means 1 and a second conduit means 2 with a connecting trachea 3 releasably engageable therebetween. It should be known that these components of the dual balloon are made of a pliable and resilient material such as rubber.

The first conduit means 1 comprises a substantially cylindrical tubular primary neck 10, a semi-spherical primary shoulder 11, and a substantially flat ring-like primary skirt 12. The primary neck 10, shoulder 11, and skirt 12 are integrally attached with the primary shoulder 11 placed between the primary neck 10 and the primary skirt 12. A plug means 13 is integrally attached to a top end of the primary neck 10. The conduit means 1 described thus far is of conventional nature and does not require further explanation.

Accordingly and similarly, the second conduit means 2 comprises a secondary neck 20, shoulder 21, and skirt 22 whose geometry, structure, and attachment are substantially identical to their respective counterparts of the first conduit means 1 described above and will not be explained further. The second conduit means 2 further comprises a truncated conical secondary receptacle 23 integrally attached to a top end of the secondary neck 20. A secondary annular slot 24 is disposed on an inside surface of the secondary receptacle 32, whose functions will be discussed later below.

The connecting trachea 3 comprises a substantially cylindrical and tubular body portion 30 with a truncated conical primary receptacle 31 and a truncated tapered secondary male portion 32 integrally attached at a first end and a second end thereof, respectively. A primary annular slot 33 is disposed on an inside surface of the primary receptacle 31, and accordingly, a secondary annular ring 34 is disposed on an outside surface of the secondary male portion 32, whose functions will also be described later below.

Figure 2:
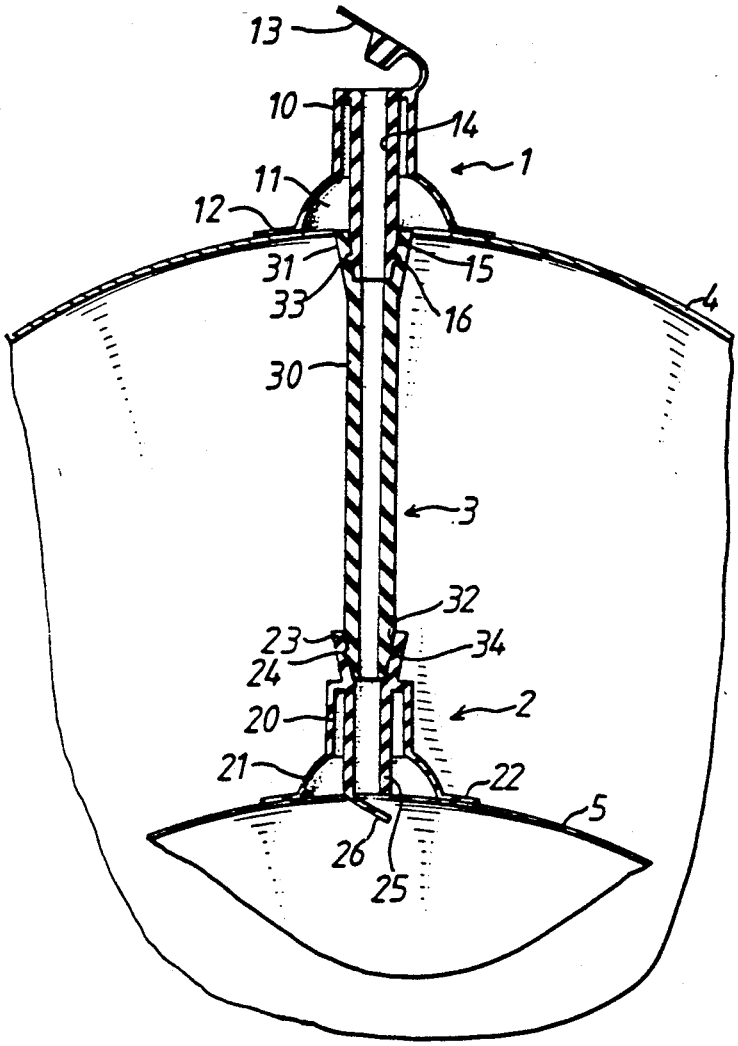
FIG. 2 is a cross-sectional view showing the first conduit means on an outer sphere and the second conduit means on an inner sphere and the connecting trachea engaged therebetween in accordance with an embodiment of the present invention.

Referring now to FIG. 2, there is shown a cross-section of these structures of the dual balloon in accordance with this invention, illustrated in relation to an outer sphere 4 and an inner sphere 5. The inner sphere 5 is radially smaller and placed inside the outer sphere 4. The two spheres 4 and 5 are of conventional nature and well known in the art.

As can be seen, the first conduit means 1 further internally and unconventionally comprises a cylindrical tubular primary trachea 14 with a truncated tapered primary male portion 15 integrally positioned at an internal end thereof. A primary annular ring 16 is disposed on an outside surface of the primary male portion 15. An external end of the primary trachea 14 is integrally attached at the top end of the primary neck 10 so that the plug means 13 is removably engageable with the external end of the primary trachea 14.

Accordingly, the second conduit means 2 also further internally and unconventionally comprises a cylindrical tubular secondary trachea 25 integrally attached to the top end of the secondary neck 20 such that the secondary receptacle 23 and the secondary trachea 25 are aligned. A flap-like valve means 26 is integrally attached to an internal end of the secondary tracheas 25, and is openable and closable depending upon air flow through the secondary trachea 25 or air pressure of the outer sphere 4 and inner sphere 5 (also to be discussed later).

Still referring to FIG. 2 it can be seen that the first conduit means 1 and the second conduit means 2 are securely fixed to outside (external) surfaces of the outer sphere 4 and the inner sphere 5, respectively, by hermetically sealing the primary skirt 12 and secondary skirt 22 to these outside surfaces, respectively, by a conventional means such as gluing. The internal end of the primary trachea 14 extends into the outer sphere 4 be means of a hole (not shown) in the outer sphere 4. The internal end of the secondary trachea 25 extends to and is flush with the outside surface of the inner sphere 5 such that a hole (also not shown) in the inner sphere 5 sealable by the valve means 26 being flush with an inside surface of the inner sphere 5.

FIG. 2 further illustrates an engaged configuration of the first conduit means 1, the second conduit means 2, and the connecting trachea 3. The primary and secondary male portions 15 and 32 are releasably engageable with the primary and secondary receptacles 31 and 23, respectively, with the primary and secondary annular rings 16 and 34 being received by the primary and secondary annular slots 33 and 24, respectively. It can be seen by this engagement that an unobstructed air path is provided from the external end of the primary trachea 14 to the internal end of the secondary trachea 25 via the connecting trachea 3, allowing the inner sphere 5 to be inflated externally, outside of the outer sphere 4.

Additionally, the truncated tapered structure of the primary and secondary male portions 15 and 32 and the truncated conical structure of the primary and secondary receptacles 31 and 23 facilitate the releasable engagement of the first and second conduit means 1 and 2 with the connecting tracheas 3. The primary and secondary annular rings 16 and 34 and the primary and secondary annular slots 33 and 24 provide a releasably secure engagement, not allowing the male portions 15 and 32 to be easily dislodged from the receptacles 31 and 23, respectively.

Figure 3:
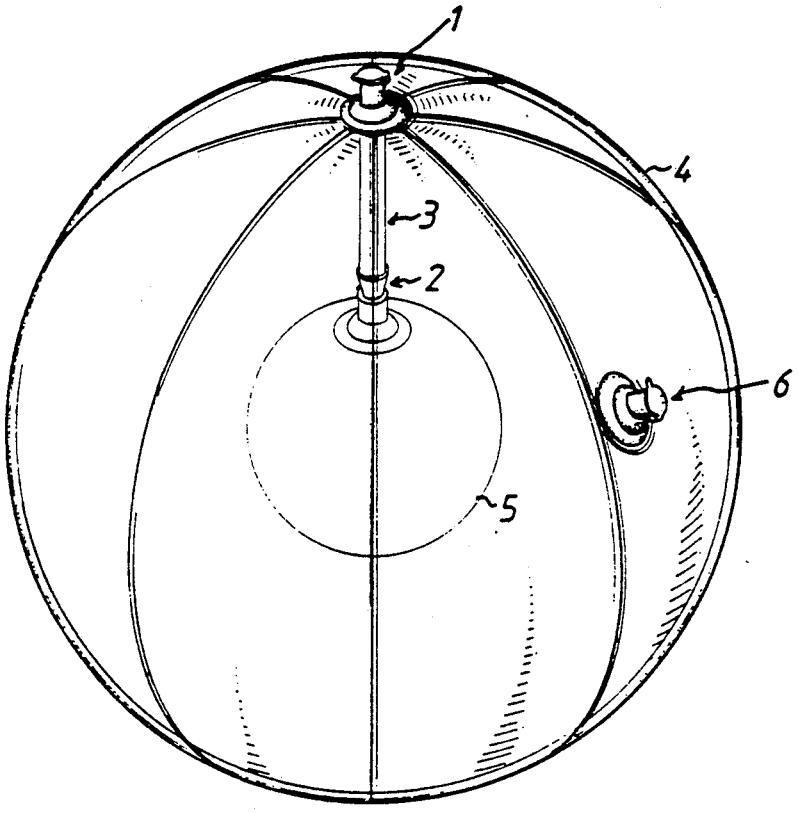
FIG. 3 is a perspective view showing the dual balloon in the embodiment of FIG. 2.

A preferred embodiment of the dual balloon is shown in FIG. 3. As can be seen, the inner sphere 5 is suspended inside the outer sphere 4 by means of the engagement of the first and second conduit means 1 and 2 with the connecting trachea 3. A supplementary conduit means 6 is additionally provided in the outer sphere 4 and is of the same general construction of a conventional conduit means.

An inflation procedure could proceed as follows: the user (1) insures that the conduit means 1 and 2 and the connecting trachea 3 are engaged; (2) inflates the inner sphere 5 by means of the previous engagement; and (3) inflates the outer sphere 4 by means of the supplementary conduit means 6. It should be known, as with conventional conduit means, that the primary and supplementary conduit means 1 and 6 can be inserted into the outer sphere 5, i.e., top surfaces of the plug means of the conduit means (13 and not labeled on 6) are flush with the outside (external surface of the outer sphere.

Figure 4:
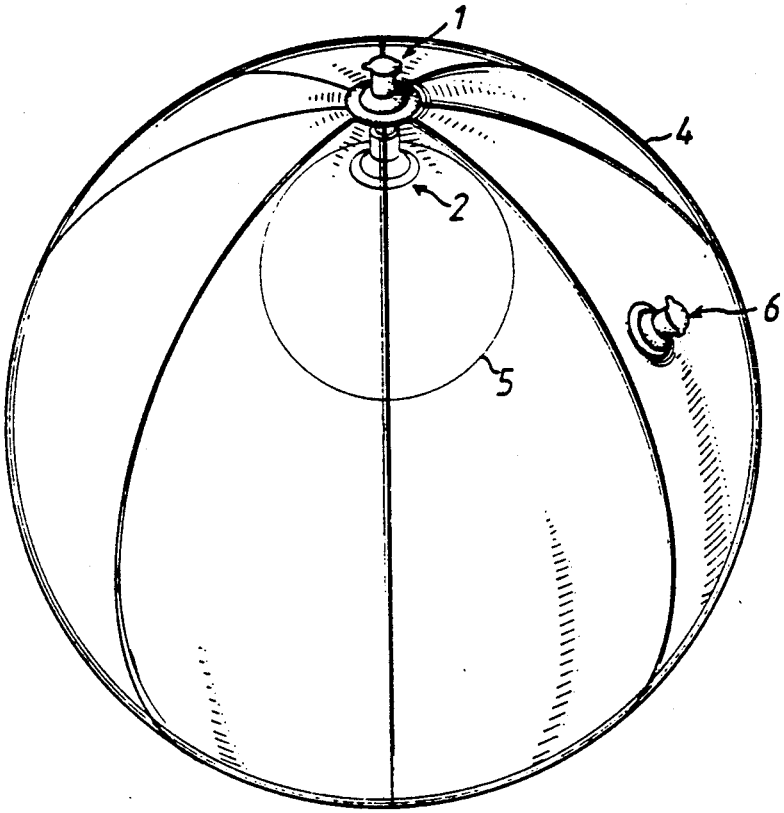
FIG. 4 is a similar view to FIG. 3 but showing the dual balloon in another embodiment of the present invention.

FIG. 4 shows a further embodiment of the present invention where the second conduit means 2 directly engages with the first conduit means 1 without the use of the connecting trachea 3. More specifically, the primary male portion 15 engages with the secondary receptacle 23 with the primary annular ring 16 received by the secondary annular slot 24. Any remaining description is substantially identical with the previously described embodiment.

Figure 5:
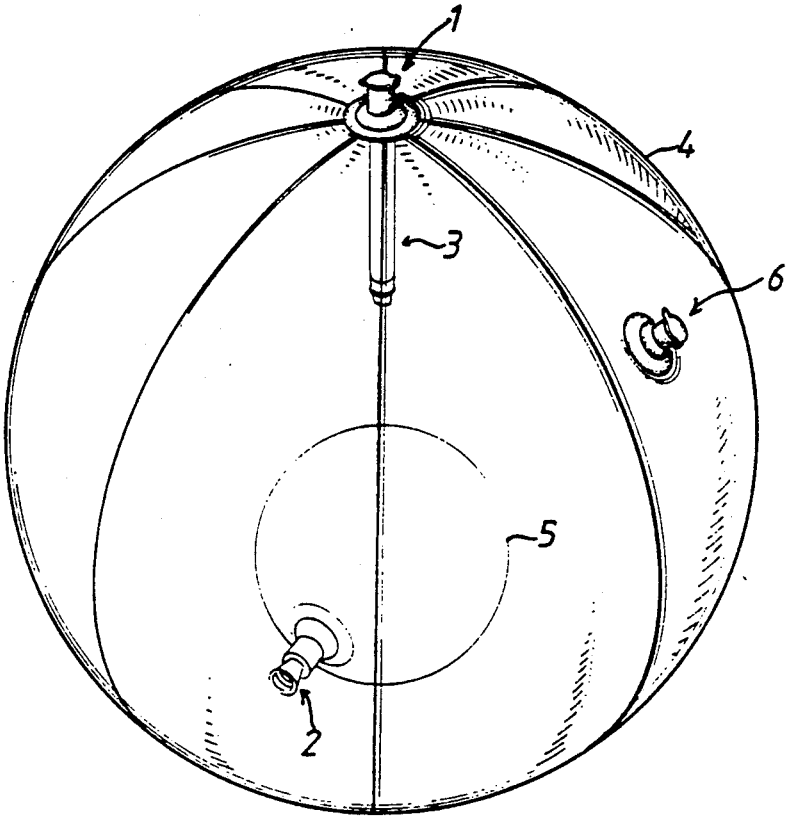
FIG. 5 illustrates a possible further embodiment of the dual balloon of FIG. 3.

And FIG. 5 shows the inner sphere 5 disconnected from the outer sphere 4, either by a disengagement of the second male portion 32 with the secondary receptacle 23 (as shown), or by the disengagement of the primary male portion 15 with the primary receptacle 31 (not shown). The inner sphere 5 would remain inflated due to air pressure principles of the following situations: (1) if the air pressure of the inner sphere 5 is greater that the air pressure of the outer sphere 4, then the valve means 26 will remain closed due to air escaping the inner sphere to the outer sphere; or, conversely, (2) if the air pressure of the inner sphere 5 is less than the air pressure of the outer sphere 4, then the valve means 26 will remain open due to air entering the inner sphere from the outer sphere, and in this case, equilibrium of the air pressures would occur.

In conclusion, a dual balloon has been described, including means for engaging and inflating two spheres, an inner and an outer. The scope of the present invention should not be limited by the literal description given above. Accordingly, other uses and modifications will be apparent to a person of ordinary skill in the art and all such modifications are intended to be within the scope of the appended claims.

I claim:

1. A dual balloon comprising (a) an outer sphere having first conduit means for allowing gas to flow therethrough, wherein said first conduit means of said outer sphere includes a primary trachea having a primary male portion;

(b) an inner sphere having second conduit means for allowing gas to flow therethrough, wherein said second conduit means of said inner sphere includes a secondary trachea having a secondary receptacle; and, (c) a connecting trachea releasably engageable between said first conduit means of said outer sphere and said second conduit means of said inner sphere, said connecting trachea having a primary receptacle and an opposite secondary male portion releaseably engageable with said primary male portion and said secondary receptacle respectively.

2. The dual balloon as claimed in claim 1, wherein:

said primary male portion of said primary trachea having a primary annular ring formed on an outside surface thereof releasably receivable into a corresponding primary annular slot formed on an inner wall of said primary receptacle of said connected trachea; and said secondary male portion of said connecting trachea having a secondary annular ring formed on an outside surface thereof releasably receivable with a corresponding secondary annular slot formed on an inner wall of said secondary receptacle of said secondary trachea.

3. A dual-balloon comprising:

(a) an outer sphere having first conduit means for allowing gas to flow therethrough; said first conduit means of said outer sphere including a primary trachea having a primary male portion; and, (b) an inner sphere having second conduit means for allowing gas to flow therethrough and being releaseably engageable with said first conduit means of said outer sphere, said second conduit means of said inner sphere including a secondary trachea having a secondary receptacle releaseably engageable with said primary male portion of said primary trachea, said primary male portion of said primary trachea having a primary annular ring formed on an outside surface thereof and releaseably receivable into a corresponding secondary annular slot formed on an inner wall of said secondary receptacle of said secondary trachea.

4. The dual-balloon as claimed in claim 3, further comprising a connecting trachea releasably engageable between said first conduit means of said outer sphere and said second conduit means of said inner sphere.

* * * * *